US007050970B2

(12) United States Patent
Den Brinker

(10) Patent No.: US 7,050,970 B2
(45) Date of Patent: May 23, 2006

(54) PARAMETRIC CODING OF AN AUDIO OR SPEECH SIGNAL

(75) Inventor: Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 875 days.

(21) Appl. No.: 10/046,472

(22) Filed: Jan. 14, 2002

(65) Prior Publication Data

US 2002/0156621 A1 Oct. 24, 2002

(30) Foreign Application Priority Data

Jan. 16, 2001 (EP) ..... 01200142
Jul. 6, 2001 (EP) ..... 01202612

(51) Int. Cl.
*G10L 19/04* (2006.01)
*G10L 19/00* (2006.01)

(52) U.S. Cl. ..... 704/220; 704/254; 704/500

(58) Field of Classification Search ..... 704/220, 704/254, 500
See application file for complete search history.

(56) References Cited

U.S. PATENT DOCUMENTS 4,937,873 A * 6/1990 McAulay et al. ..... 704/265

OTHER PUBLICATIONS den Drinker, et al. "Sinusoids plus noise modeling for audio signals," 17th AES Conf., Florence, Sep. 1999, pp. 226-232.*

By E.B. George & M.J.T. Smith, "A New Speech Coding Model Based on Least-Squares Sinusoidal Representation", Proc. 1987 Int. Conf. Acoustic, Speech Signal Processing, (ICASSP87), pp. 1641-1644, Dallas Texas, Apr. 6-9, 1987, IEEE, Piscataway, NJ.

By R. Mucaulay & T. Quartieri, "Speech Analysis/Synthesis Based on Sinusoidal Representation" IEEE Transaction on Acoustics, Speech Siganl Process., Aug. 4, 1986 vol. 34, pp. 744-754.

By B. Elder, "Technical Description of the MPEG-4 Audio-Coding Proposal From University of Hannover and Deutsche Bundespost Telecom", Technical Note MPEG95/0414, Int. Organization for Standardization ISO/IEC JTCI/SC29/WG11, Feb. 1996, pp. 2-11.

(Continued)

*Primary Examiner*—Richemond Dorvil
*Assistant Examiner*—V. Paul Harper
(74) *Attorney, Agent, or Firm*—Larry Lieberchuk

(57) ABSTRACT

An encoder includes a segmentation unit for segmenting an audio or speech signal into at least one segment and a calculation unit for calculating sinusoidal code data in the form of frequency and amplitude data of a given extension from the segment such that the extension approximates the segment for a given criterion. The calculation of the sinusoidal code data $\theta_k^i$, $d_j^i$ and $e_j^i$ for the segment x(n) is carried out according to the following extension $\hat{x}$:

$$\hat{x} = \sum_{i=1}^{L} \sum_{j=0}^{J-1} [d_j^i f_j(n)\cos(\Theta^i(n)) + e_j^i f_j(n)\sin(\Theta^i(n))].$$

Fig. 1.

14 Claims, 3 Drawing Sheets

OTHER PUBLICATIONS

By M. Goodwin, "Matching Pursuit with Damped Sinusoids", IEEE Int. Conf. Acoustics, Speech Signal Process, vol. 3, pp. 2037-2040, May 1997.

By M. Goodwin & M. Vetterli, "Matching Pursuit and Atomic Signal Models Based on Recursive Filter Banks", IEEE Transactions on Signal Processing, vol. 47, Jul. 7, 1999, pp. 1890-1902.

By K.N. Hamdy, M. Ali & A.H. Tewfik, "Low Bit Rate High Quality Audio Coding with Combined Harmonic and Wavelet Representations", Proc. . 1996 Int. Conf. Acoustic Speech Signal Process. (ICASSP96), pp. 1045-1048, Atlanta GA, May 7-10, 1996, IEEE Piscataway New Jersey.

By Xavier Serra "Musical Sound Modeling with Sinusoids Plus Noise", C. Roads, S. Pope, A. Picialli, G. De Poli, Editors, Musical Signal Processing, Swets & Zeitling, 1997, pp. 91-122.

J. Nieuwenhuijse, R. Heusdens & Ed F. Deprettere, "Robust Exponential Modeling of Audio Signals", Proc. SPS 98, pp. 143-146M Leuve, Belgium, Mar. 26-27, 1998.

By M. Fargues & R. D. Hippenstiel "The Thirty First Asilomar Conference on Siganls", Systems & Computers, Sponsored by the Naval Postgraduate Scholl, Monterey, CA, San Hose State University, Nov. 2-5, 1997, pp. 12-84-1288.

By M. Goodwin & M. Vetterli, "Atomic Decompositions of Audio Signals", Department of Electrical Engineering & Computer Science University of California at Berkley, 1997.

By M. Goodwin & M. Vetterli, "Atomic Signal Models Based on Recursive Filter Banks", IEEE, 1998, pp. 1284-1288.

* cited by examiner

PARAMETRIC CODING OF AN AUDIO OR SPEECH SIGNAL

The invention relates to a parametric encoder and method for encoding an audio or speech signal into sinusoidal code data.

The invention further relates to a parametric decoder and method for re-constructing an approximation of said audio or speech signal from said sinusoidal code data.

Audio and speech signals are preferably encoded before being transmitted via a channel or stored on a storage medium in order to compress the data of said signals. Audio or speech signals are substantially represented by sinusoidal code data and consequently specific encoders are known in the art specialised for the encoding of these signals. Such a parametric encoder is e.g. known from E. B. George and M. J. T. Smith, "A new speech coding model based on a least-squares sinusoidal representation". In Proc. 1987 Int. Conf. Acoust. Speech Signal Process. (ICASSP87), pages 1641–1644, Dallas Tex., 6–9 Apr. 1987. IEEE, Picataway, N.J. The parametric encoder described there is illustrated in FIG. 5. According to FIG. 5 the parametric encoder 500 comprises a segmentation unit 510 for segmenting a received audio or speech signal s into at least one finite segment x(n).

Said segment x(n) is input to a calculation unit 520. Said calculation unit 520 calculates sinusoidal code data in the form of phase and amplitude data of a given extension $\hat{x}$ from the segment x(n) such that the extension $\hat{x}$ approximates the segment x(n) as good as possible for a given criterion, e.g. minimum of weighted squared error. For the cited parametric encoder the extension is given by $$\hat{x}(n) = \sum_{i=1}^{L} A^i(n)\cos(\Phi^i(n)) \tag{1}$$

with $$A^i(n) = \sum_{j=0}^{J-1} a_j^i n^j \tag{2}$$

$$\Phi^i(n) = \sum_{k=0}^{K-1} \phi_k^i n^k \tag{3}$$

with $a_J^l$ and $\phi_k^l$ are polynomial coefficients of the amplitude parameter $A^i$ and of the phase parameter $\Phi^l$.

The calculation unit 520 comprises a frequency estimation unit 522 for calculation the phase coefficients $\phi_k^l$ from the received segment x(n) for example, for k=1 (thus $\phi_1^l$), by picking frequencies in the frequency spectrum of said segment x(n). These phase coefficients $\phi_k^l$ represent the phase part of said sinusoidal code data are on one hand output to a multiplexer 530 and are on the other hand input into a pattern generation unit 524. Said pattern generation unit serves for calculating the phase parameter $\Phi^i(n)$ according to equation (3).

The pattern generation unit 524 further generates a plurality of J×L components $p_{ij}$ of the extension $\hat{x}(n)$ according to $$p_{ij}(n)=n^j \cos(\Phi^i(n)), \text{ with } i=1-L, j=0-(J-1)$$

The plurality of J×L components $p_{ij}$ is input to an amplitude estimation unit 526 which determines the optimal amplitude data $a_j^l$ from said received components as well as from the received segment x(n) output from the segmentation unit 510.

The phase coefficients $\phi_k^l$ and the amplitudes $a_j^l$ form the sinusoidal code data which represents the extension $\hat{x}(n)$ as an approximation of the segment x(n). These sinusoidal code data are multiplexed by the multiplexer 530 in order to form a data stream which may be stored on a recording medium or transmitted via a channel.

The extension $\hat{x}(n)$ as described by equation 1 and as known from the described parametric encoder 500 provides a proper approximation for an individual segments x(n) of the audio or speech signal. However, the calculation of the sinusoidal code data is rather complicated.

Starting from that prior art it is an object of the invention to improve a known parametric encoder and method for encoding an audio or speech signal into sinusoidal code data and to improve a known parametric decoder and method for re-constructing an approximation of said audio or speech signal from said sinusoidal code data after transmission or restoration such that the calculation of said sinusoidal code data can be carried out in a simpler and cheaper way.

This object is solved by adapting the calculation unit to calculate the sinusoidal code data $\theta_k^i$, $d_j^i$ and $e_j^i$ for the following extension $\hat{x}$:

$$\hat{x}(n) = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i | represents a component of the extension $\hat{x}$ (n); |
| j,k | represent parameters; |
| n | represents a discrete time parameter; |
| $\theta_k^i$ | represents the phase coefficient value as one of said sinusoidal code data |
| $f_j$ | represents the jth instance out of the set of J linearly independent fuctions; |
| $\Theta^i$ | is a phase; and |
| $d_j^i$, $e_j^i$ | represent the linearly involved amplitude values of the components representing the amplitude parts of said sinusoidal code data. |

Advantageously, the optimisation problem occurring when trying to define the sinusoidal data such that the claimed extension $\hat{x}$ accurately describes a specific segment x(n) is easy to solve. The easy calculation results from the fact that except the phase coefficients $\theta_k^l$ the amplitude data $d_j^l$ and $e_j^l$ are linearly involved within the claimed extension $\hat{x}$. Note that there does not appear a zeroth order phase coefficient in $\Theta^l$, whereas such component exists in $\Phi^l$ in the form of $\phi_0^l$.

Further, advantageously the claimed extension $\hat{x}$ provides more degrees of freedom for defining the sinusoidal code data with the result, that the claimed extension $\hat{x}$ is broader than the extensions known in the art and provides a more accurate approximation of an individual segment x(n).

According to a first embodiment of the invention the linearly independent function $f_j(n)$ is set to $f_j(n)=n^j$. In that way the claimed extension $\tilde{x}$ is restricted to a polynomial extension.

Further advantageous embodiments of the claimed parametric encoder and in particular of the claimed calculation unit are subject matter of the dependent encoder claims.

The above identified object is further solved by a method for encoding an audio or speech signal. The advantages and embodiments of the said method correspond to the advantages and embodiments as explained above for the parametric encoder.

The above identified object is further solved by a parametric decoder for re-constructing an approximation $\tilde{x}$ of an audio or speech signal from transmitted or restored code data. More specifically, the object is solved by adapting a known synthesiser to re-construct said segments $\tilde{x}$ from said sinusoidal code data $\phi_k^i$ and $e_j^i$ according to the following formula:

$$\tilde{x}(n) = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i | represents a component of the extension $\hat{x}$ (n); |
| j,k | represent parameters; |
| n | represents a discrete time parameter; |
| $f_j$ | represents the jth instance out of the set of J linearly independent functions; |
| $\theta_k^i$ | represents the phase coefficient as one of said sinusoidal data |
| $\Theta^i$ | is a phase parameter; and |
| $d_j^i$, $e_j^i$: | represent the linearly involved amplitude values of the components representing parts of said sinusoidal data. |

$d_j^i$,$e_j^i$: represent the linearly involved values of the components represention parts of said simusoidal data.

Advantageously, the calculation of the claimed extension $\tilde{x}$ is easier than the calculation of the extensions known in the art. This is due to the linear involvement of the amplitude data $d_j^l$ and $e_j^l$ within said extension and the omission of the zeroth-order phase coefficient.

Due to the easy calculation of the extension $\tilde{x}$ the reconstruction of the original audio or speech signal s in the form of its approximation $\tilde{x}$ can be realised cheaper and quicker.

The above identified object is further solved by the decoding method as claimed by claim 12. The advantages of said method correspond to the advantages mentioned above by referring to the parametric decoder.

Five figures are accompanying the description, wherein

Before describing the preferred embodiments of the invention some basic explanations about the subject matter of the invention are given.

The invention proposes an extension $\tilde{x}(n)$ for approximating a segment x(n) of a sinusoidal audio or speech signal s. Said extension $\tilde{x}(n)$ is represented by phase and amplitude data, hereinafter also referred to as sinusoidal code data. The sinusoidal code data is defined such that the extension $\tilde{x}(n)$ approximates the segment x(n) of the audio or speech signal as good as possible for a given criterion, e.g. minimisation of the squared weighted error. Expressed in other words, the sinusoidal code data has to be defined by solving an optimisation problem. After the sinusoidal code data has been defined for optimally approximating a particular segment x(n) it might be stored on a storage medium or transmitted via a channel as code data representing said segment x(n) and thus also representing said audio or speech signal s. Preferably, before being stored or transmitted the sinusoidal code data might be encoded and/or cleaned in the way that irrelevant or redundant data is removed from it.

Figure 1:
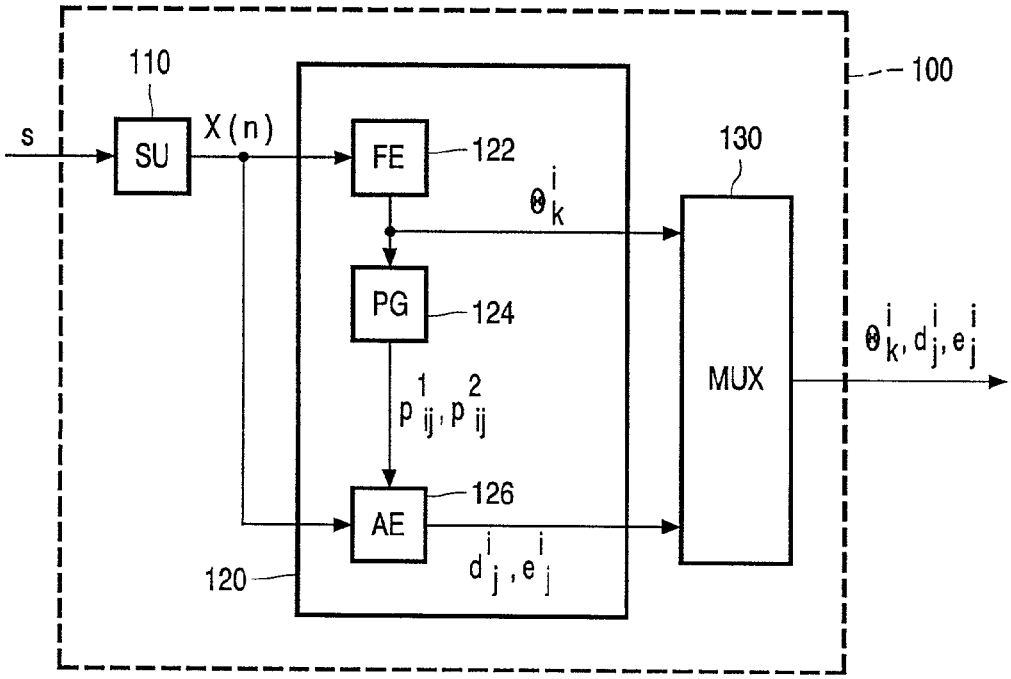
FIG. 1 shows a first embodiment of the parametric encoder according to the invention.

The generation of said sinusoidal code data according to a first embodiment is now explained by referring to FIG. 1.

FIG. 1 shows a first preferred embodiment of a parametric encoder 100 for generating said sinusoidal code data representing an input audio or speech signal s. The received signal s is input to a segmentation unit 110 for segmenting said signal s into at least one segment x(n). Said segment x(n) is input into a calculation unit 120 for generating said sinusoidal code data such that the extension $\tilde{x}$ with $$\tilde{x}(n) = \sum_{i=1}^{L} \sum_{j=0}^{J-1} [d_j^i f_j(n)\cos(\Theta^i(n)) + e_j^i f_j(n)\sin(\Theta^i(n))] \tag{4}$$

with $$\Theta^i(n) = \sum_{k=1}^{K} \theta_k^i n^k \tag{5}$$

and wherein:

| | |
|---|---|
| i,j,k | represent parameters; |
| n | represents a discrete time parameter; |
| $\theta_k^i$ | represents the phase coefficient as one of said sinusoidal data |
| $f_j$ | represents the jth instance out of the set of J linearly independent functions; |
| $\Theta^i$ | is a phase; and |
| $d_j^i$,$e_j^i$ | represent the linearly involved amplitude values of the components representing parts of said sinusoidal data |

The segment x(n) input to said calculation unit 120 is approximated as good as possible for a given criterion, e.g. minimisation of weighted squared error. The sinusoidal code data to be determined by said calculation unit 120 is the phase $\theta_k^i$ and the amplitude data $d_j^i$ and $e_j^i$, where certain terms in equation (4) are defined as Ci as shown in below.

$$Ci = \sum_{j=0}^{J-1} [d_j^i f_j(n)\cos(\Theta^i(n)) + e_j^i f_j(n)\sin(\Theta^i(n))] \tag{6}$$

is hereinafter referred to as the i'th component of the extension $\tilde{x}$ with i=1–L.

The calculation unit 120 comprises a frequency estimation unit 122 for determining a plurality of L×K phase coefficients $\theta_k^l$ with k=1–K for all components Ci with i=1–L of the extension $\hat{x}(n)$ according to formula (5) representing the individually received segment x(n). Said plurality of L×K frequencies $\theta_k^l$ is input to a pattern generating unit 124 for calculating a plurality of L frequency parameters $\Theta^l(n)$ with i=1–L according to formula (5). Said pattern generating unit 124 is further adapted for generating a plurality of J×L pairs of patterns $p_{ij}^1$, $p_{ij}^2$, for the components Ci with i=1–L according to:

$p_{ij}^1=f_j(n)\cos(\Theta^l(n))$; and $p_{ij}^2=f_j(n)\sin(\Theta(n))$ for i=1–L and j=0–(J–1).

Said plurality of pairs of patterns $p_{ij}^1$, $p_{ij}^2$ is —together with the segment x(n)—input to an amplitude estimation unit 126 for determining a plurality of J×L amplitude data $d_j^i$ for all received patterns $p_{ij}^1$ and a plurality of J×L amplitude data $e_j^l$ for all the received patterns $p_{ij}^2$ of all components $C_i$ of the extension $\hat{x}(n)$.

The calculation unit 120 and in particular the frequency estimation unit 122 and the amplitude estimation unit 126 are adapted such that the sinusoidal data comprising the phase data $\theta_k^l$ and the amplitude data $d_j^l$ and $e_j^l$ is determined and optimised such that the criterion "minimisation of weighted squared error E between the segment x(n) and the extension $\hat{x}(n)$" is (approximately) fulfilled.

The parametric encoder 100 may further comprise a multiplexer 130 for transforming the plurality of L×K phase coefficients $\theta_k^l$ as output by said frequency estimation unit 122 and said plurality of J×L amplitude data $d_j^l$ and $e_j^l$ as output by said amplitude estimation unit 126 into a data stream to be stored on a storage medium or to be transmitted via a channel.

Figure 2:
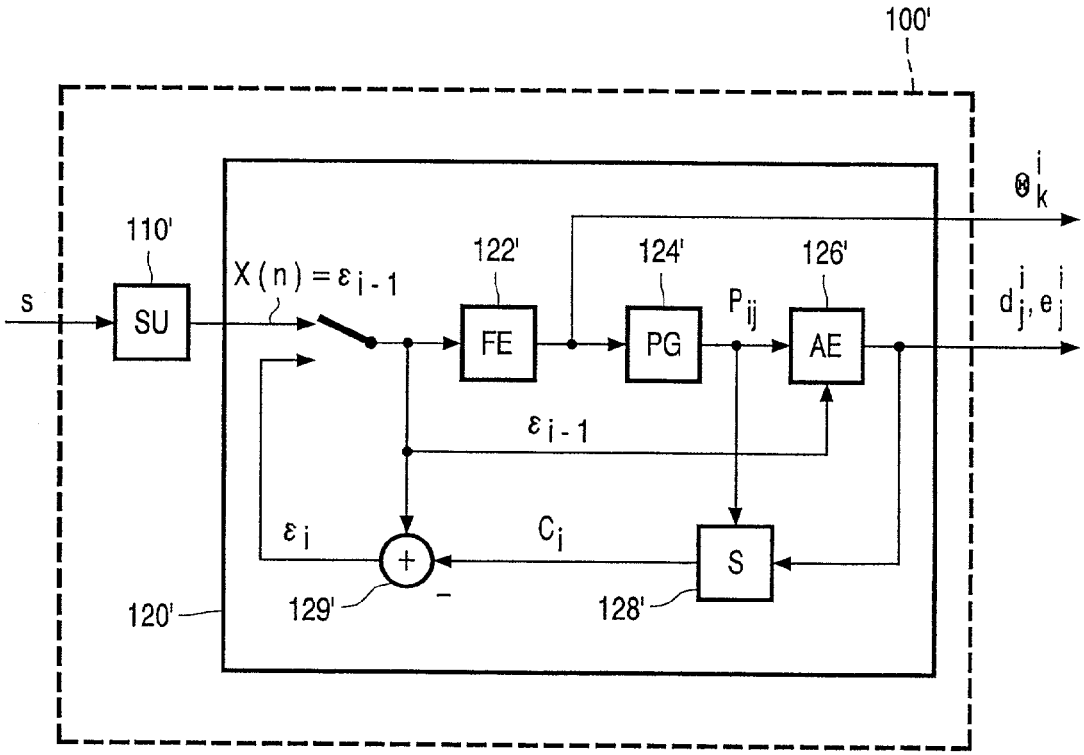
FIG. 2 shows a second embodiment of the parametric encoder according to the invention.

FIG. 2 shows a second embodiment of the parametric encoder 100'. Like the parametric encoder 100 the parametric encoder 100' also serves for generating said sinusoidal code data from the input audio or speech signal s. The operation of its segmentation unit 110' corresponds to the operation of the segmentation unit 110. Consequently, the segmentation unit 110' generates segments x(n) of the received signal s at its output. Said segments x(n) are input to a calculation unit 120'. In difference to the first embodiment of the calculation unit 120 the calculation unit 120' does not calculate the plurality of sinusoidal code data simultaneously for all components of a segment $\hat{x}(n)$ but generates this sinusoidal code data sequentially for each component Ci with i=1–L of the extension $\hat{x}$. This way of calculation is generally known in the art as analysis-by-synthesis or as matching pursuit algorithm. However, in the prior art an application of said method is only known for extensions different from the claimed extension $\hat{x}$ according to formula (4).

In the following the operation of said second embodiment of the calculation unit 120' is explained by referring to FIGS. 2 and 3. More specifically, the calculation of the sinusoidal code data of the extension $\hat{x}$ according to equation (4) is described such that the weighted squared error between a segment output by the segmentation unit 100' and its extension $\hat{x}$ according to equation (4) is (approximately) minimised.

Figure 3:
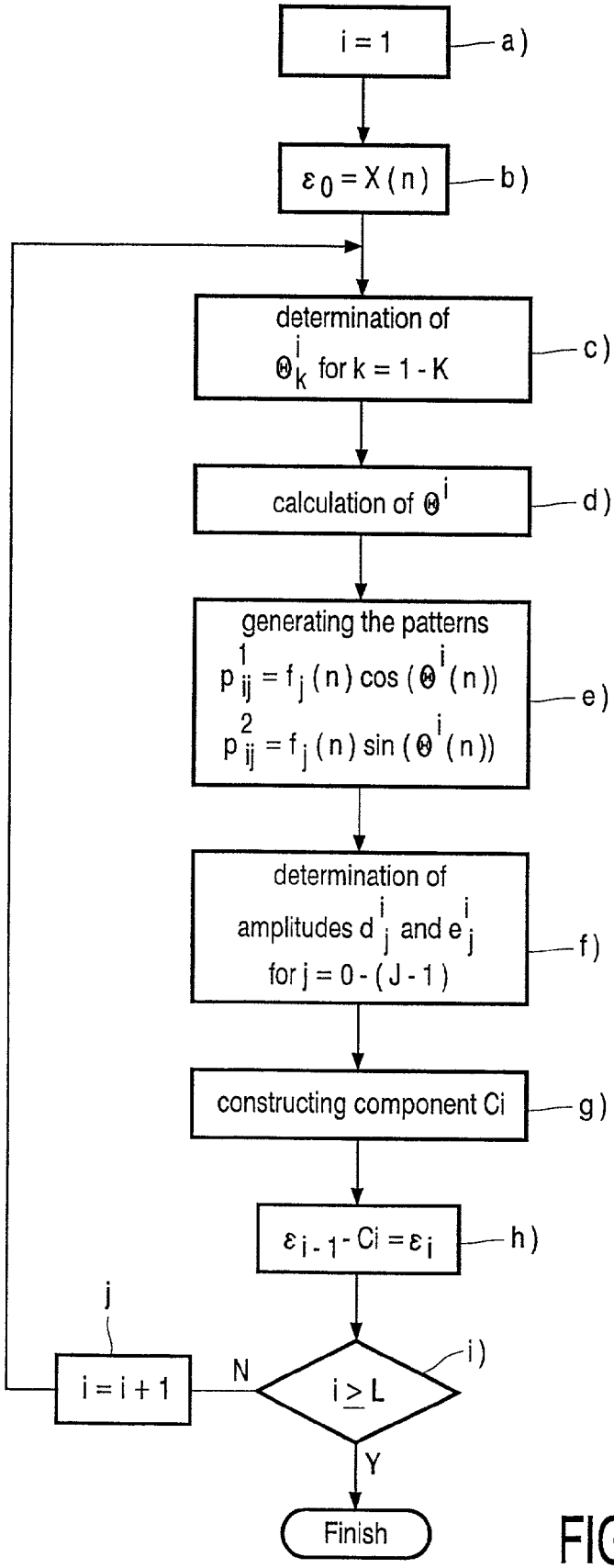
FIG. 3 shows a flow chart illustrating the operation of the second embodiment of the parametric encoder according to the invention.

In a first cycle i=1 the sinusoidal code data of a first component Ci with i=1 of the extension $\hat{x}$ are calculated (method step a) in FIG. 3).

For achieving this, the output of segmentation unit 110'x(n) is set to: $\epsilon_{i-1}$=x(n) (see method step b)).

In said first cycle, said output of the segmentation unit 110' is input to a frequency estimation unit 122' for determining a plurality of K phase coefficients $\theta_k^l$ with k =1–K from the input value $\epsilon_{i-1}$ (see method step c)). Said phase coefficients $\theta_k^l$ represent the phases of the searched sinusoidal code data and are thus output from the calculation unit.

Moreover, said phase coefficients $\theta_k^l$ are input to a pattern generating unit 124' for calculating the phase $\Theta^l$ with i=1 for the first component C1 according to equation (5) (see method step d)). Said pattern generating unit 124' further serves for generating a plurality of 2×J patterns with j=0–(J–1) for the component Ci with:

$p_{ij}^1=f_j(n)\cos(\Theta^l(n))$; and $p_{ij}^2=f_j(n)\sin(\Theta^l(n))$ for i=1 (see method step e)). These generated patterns $p_{ij}^1$, $p_{ij}^2$ are —together with the parameter $\epsilon_{i-1}$ —input to an amplitude estimation unit 126'. Said amplitude estimation unit 126' serves for determining a plurality of J amplitudes $d_j^l$ for said patterns $p_{ij}^l$ and of J amplitudes $e_j^l$ for said patterns $p_{ij}^2$ for the component Ci with i=1 from the received input data (see method step f)). Said calculated amplitudes $d_j^l$ and $e_j^l$ form the amplitude part of the sinusoidal data representing the extension $\hat{x}$ of the segment x(n) and are thus output from that calculation unit 120' in order to be—together with said phase data $\theta_k^l$ merged into a data stream representing said first component Ci with i=1. Moreover, said amplitude data $d_j^l$ and $e_j^l$ are—together with their respective patterns $p_{ij}^1$ and $p_{ij}^2$ input into a synthesiser 128' for calculating the component Ci with i=1 according to $$C_i = \sum_{j=0}^{J-1} [d_j^i f_j(n)\cos(\Theta^i(n)) + e_j^i f_j(n)\sin(\Theta^i(n))]$$

(see method step g)).

Said component Ci is input into a subtracting unit 129' for being subtracted from the value $\epsilon_{i-1}$ being input to said frequency estimation unit 122'. The difference occuring at the output of said subtracting unit 129' is referred to as $\epsilon_i$ with i=1 (see method step h)).

Now the first cycle for calculating the first component C1 and its sinusoidal code data $\theta_k^l$, $d_j^l$, and $e_j^l$, for the extension $\hat{x}$ has been finished. Subsequently, the parameter i is compared with the total number L of components Ci of the segment $\hat{x}$ (see method step i)). If i<L method steps c) to i) are repeated for i=i+1. In these cases the output from the segmentation unit 110' for i≧1 is disconnected from the input of the frequency estimation unit 122'; instead, the input of said frequency estimation unit 122' is connected to the output of said subtracting unit 129' for receiving the differences $\epsilon_i$. However, if i≧L the sinusoidal code data of all L components of the extension $\hat{x}$ have been calculated and thus the calculation process carried out by the calculation unit 120' has been finished for a particular segment $\hat{x}$. Subsequently, the whole procedure may be repeated for a subsequent segment of the input audio or speech signal.

Figure 4:
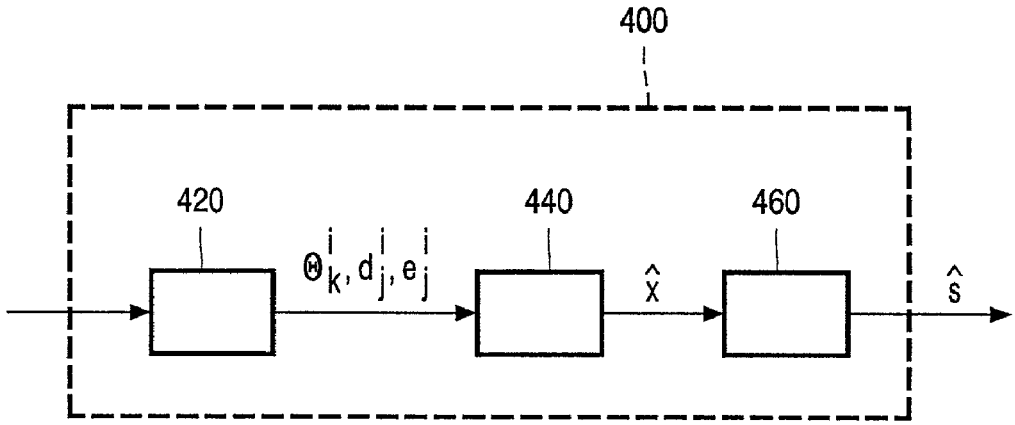
FIG. 4 shows a parametric decoder according to an embodiment of the invention.
Figure 5:
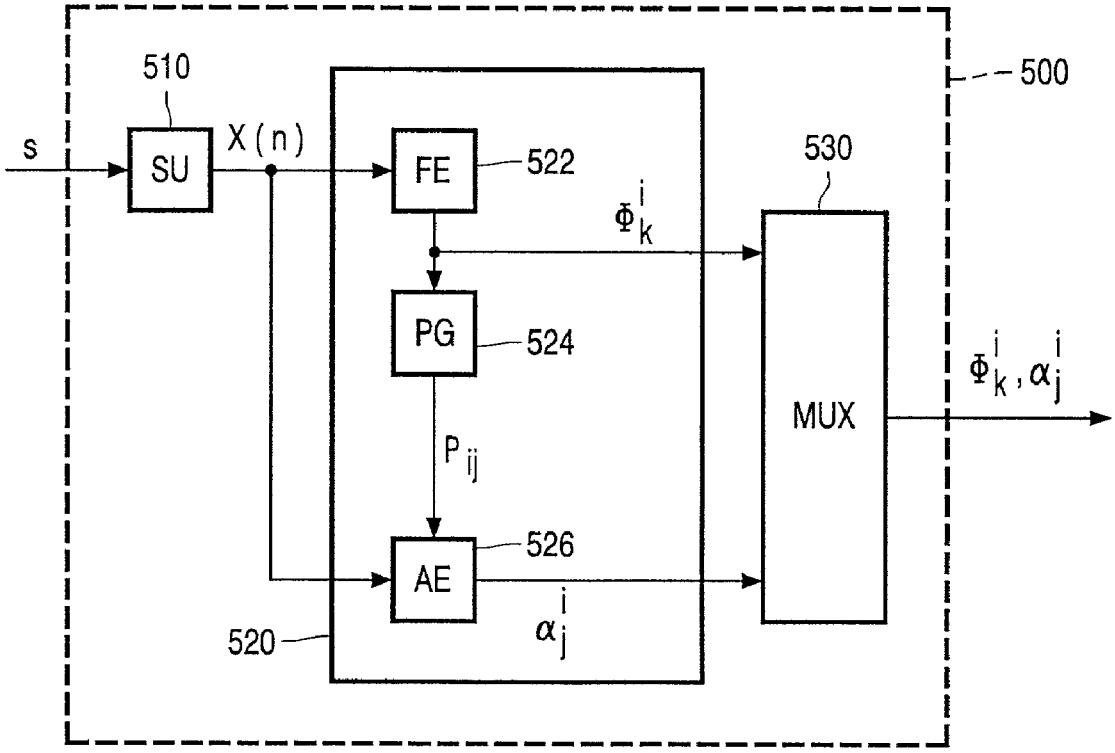
FIG. 5 shows a parametric encoder as known in the art.

FIG. 4 shows a parametric decoder 400 for reconstructing an approximation $\hat{x}$ of an audio or speech signal s from received input data. These received input data correspond to data of a data stream after being transmitted or restored from a storage medium.

The parametric decoder 400 comprises a selecting unit 420 for selecting sinusoidal code data $\theta_k^l$, $d_j^l$ and $e_j^l$ representing segments $\hat{x}$ of the approximation $\hat{x}$ of the audio and/or speech signal s from said received input data. The parametric decoder 400 further comprises a synthesiser 440 for reconstructing said segments $\hat{x}$ from said received sinusoidal code data and a joining unit 460 for re-constructing the approximation $\hat{x}$ by linking the re-constructed segment $\hat{x}$.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A parametric encoder for encoding an audio or speech signal into sinusoidal code data, comprising:

a segmentation unit for segmenting said signal into at least one segment;

a calculation unit for calculating said sinusoidal code data in the form of the phase and amplitude data of an extension from the segment such that the extension approximates the segment;

wherein the calculation unit is adapted to calculate the sinusoidal code data $\theta_k^i$, $d_j^i$ and $e_j^i$ for the extension represented by:

$$\hat{x} = \sum_{i=1}^{L} Ci = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K-1} \theta_k^i n^k$$

wherein:

| | |
|---|---|
| i,j,k | represent parameters; |
| n | represents a discrete time parameter; |
| Ci | represents the i'th component of the extension $\hat{x}$; |
| $\theta_k^i$ | represents the phase coefficient as one of said sinusoidal data |
| $f_j$ | represents the jth instance out of the set of J linearly independent functions; |
| $\Theta^i$ | is a phase; and |
| $d_j^i, e_j^i$ | represent the linearly involved amplitude values of the components representing parts of said sinusoidal data. |

2. The parametric encoder according to claim 1, wherein $f_j(n)=n^j$.

3. The parametric encoder according to claim 1, wherein the calculation unit comprises:

a frequency estimation unit for determining a plurality of L×K phase coefficients $\theta_k^i$ with i=1–L and k=1–K for all components Ci of the extension representing the segment;

a pattern generating unit or calculating a plurality of L phases $\Theta^i(n)$ with i=1–L from the phase coefficients $\theta_k^i$ according to:

$$\Theta^i(n) = \sum_{k=1}^{K-1} \theta_k^i n^k$$

and for generating a plurality of J×L pairs of patterns $p_{ij}^1$, $p_{ij}^2$ for the components Ci with i=1–L according to:

$$p_{ij}^1 = f_j(n)\cos(\Theta^i(n))$$

and $$p_{ij}^2 = f_j(n)\sin(\Theta^i(n))$$

for i=1–L and j=0–(J–1); and an amplitude estimation unit for determining a plurality of J×L amplitudes $d_j^i$ for the patterns $p_{ij}^1$ and a plurality of J×L amplitudes $e_j^i$ for the patterns $p_{ij}^2$ of all components Ci of extension;

wherein the sinusoidal data $\theta_k^i$, $d_j^i$ and $e_j^i$ is at least approximately optimized for a criterion that the weighted squared error E between the segment and its extension is minimized.

4. The parametric encoder according to claim 1, further comprising a multiplexer for merging said sinusoidal code data into a data stream.

5. The parametric encoder according to claim 1, wherein the calculation unit comprises:

a frequency estimation unit for determining a plurality of K phase coefficients $\theta_k^i$ with k=1–K for the component Ci from an input value $\epsilon_{i-1}$; wherein for the first component C1 with i=1 the input value is set to $\epsilon_0$ =x(n), where the segment is x(n);

a pattern generating unit for calculating the phases $\Theta_k^i$ for the component Ci from said plurality of phase coefficients $\theta_k^i$ according to:

$$\Theta^i(n) = \sum_{k=1}^{K} \theta_k^i n^k$$

and for generating a plurality of 2×J patterns $p_{ij}^1$, $p_{ij}^2$ with j=1–J for the component Ci with:

$$p_{ij}^1 = j(n)\cos(\Theta^i(n))$$

and $$p_{ij}^2 = fj(n)\cos(\Theta^i(n));$$

an amplitude estimation unit for determining a plurality of J amplitudes $d_j^i$ and of J amplitudes $e_j^i$ for said patterns of the component Ci from the segment and from the plurality of 2×J patterns $p_{ij}^1$, $p_{ij}^2$;

a synthesizer for re-constructing the component Ci from said plurality of 2×J patterns $p_{ij}^1$, $p_{ij}^2$ and form the plurality of amplitudes $d_j^i$ and $e_j^i$ according to:

$$Ci = \sum_{j=0}^{J-1} [d_j^i f_j(n)\cos(\Theta^i(n)) + e_j^i f_j(n)\sin(\Theta^i(n))]$$

and a subtraction unit for subtracting subtracting said component Ci form the input value $\epsilon_{i-1}$ in order to feed the resulting difference $\epsilon_i$ as new input value forward to the input of the frequency estimation unit for calculating the sinusoidal code data representing the component Ci+1;

wherein the sinusoidal data $\theta_k^i$, $d_j^i$ and $e_j^i$ is optimized for a criterion that the weighted squared error E between the segment and the extension extension is minimized.

6. A parametric coding method for encoding an audio or speech signal into sinusoidal code data, comprising the acts of:

segmenting the signal into at least one segment; and calculating said sinusoidal code data in the form of phase and amplitude data of an extension from the segment such that the extension approximates the segment x(n), wherein the extension is defined as:

$$\hat{x} = \sum_{i=1}^{L} Ci = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i: | represents a component Ci of the extension |
| j: | represent parameters; |
| n: | represents a discrete time parameter; |
| $f_j$: | represents the jth instance out of the set of J linearly independent functions; |
| $\theta_k^i$: | represents the phrase coefficient as one of said sinusoidal data |
| $\Theta^i$: | is a phrase; and |
| $d_j^i$, $e_j^i$: | represent the linearly involved amplitude values of the components representing parts of said sinusoidal data. |

7. The method according to claim 6, wherein $f_j(n)=n^j$.

8. The method according to claim 6, wherein the phase coefficients $\theta_1^i$ are defined by picking peak frequencies in the frequency domain of the extension.

9. The method according to claim 6, wherein, for fulfilling a criterion that the weighted squared error between the segment and the extension is minimized, the definition of the optimal amplitudes $d_j^i$ and $e_j^i$ comprises the acts of:

determining a plurality of L×K phase coefficients $\theta_k^i$ with i=1–L and k=1–K for all components Ci of the segment;

calculating a plurality of L phases $\Theta^i(n)$ with i=1–L from the phase coefficients $\theta_k^i$ according to:

$$\Theta^i(n) = \sum_{k=1}^{K} \theta_k^i n^k;$$

generating a plurality of J×L pairs of patterns $p_{ij}^1$, $p_{ij}^2$ for the components Ci with i=1–L according to:

$$p_{ij}^1 = f_j(n)\cos(\Theta^i(n))$$

and $$p_{ij}^2 = f_j(n)\sin(\Theta^i(n));\text{ and}$$

determining a plurality of J×L amplitudes $d_j^i$ and a plurality of J×L amplitudes $e_j^i$ for all the pairs of patterns $p_{ij}^1$, $p_{ij}^2$ of all components Ci of the extension $\hat{x}$.

10. The method according to claim 6, wherein, for fulfilling a criterion that the weighted squared error between the segment and the extension is minimized, a definition of the amplitudes $d_j^i$ and $e_j^i$ comprises the acts of:

a) setting i=1 b) $\epsilon_{i-1}=\epsilon_0=(n)$;

c) determining a plurality of K phase coefficients $\theta_k^i$ with k=1–K for the component Ci from an input value $\epsilon_{i-1}$;

d) calculating the phases $\Theta^i$ for the component Ci from said plurality of phase coefficients $\theta_k^i$ according to:

$$\Theta^i(n) = \sum_{k=1}^{K} \theta_k^i n^k$$

e) generating a plurality of 2×J patterns $p_{ij}^1$, $p_{ij}^2$ with j=0–(J–1) for the component Ci with:

$$p_{ij}^1 = f_j(n)\cos(\Theta^i(n))$$

and $$p_{ij}^2 = f_j(n)\sin(\Theta^i(n));$$

f) determining a plurality of J amplitudes $d_j^i$ and of J amplitudes $e_j^i$ for said patterns for the component Ci from the segment and from the plurality of 2×J patterns $p_{ij}^1$, $p_{ij}^2$;

g) constructing the component Ci from said plurality of J pairs of patterns pij and from the plurality of amplitudes $d_j^i$ and $e_j^i$ according to:

$$Ci = \sum_{j=0}^{J-1} [d_j^i f_j(n)\cos(\Theta^i(n)) + e_j^i f_j(n)\sin(\Theta^i(n))]$$

h) subtracting said component Ci from the input value $\epsilon_{i-1}$ in order to calculate a resulting difference $\epsilon_i$;

i) checking if i≧L wherein L represents a given number of components;

j) if i<L repeat the method acts by starting again from act c) with i=i+1; and k) if i≧L the sinusoidal code data of all L components of the extension have been calculated.

11. A parametric decoder re-constructing an approximation of an audio or speech signal from transmitted or restored code data, comprising:

a selecting unit for selecting sinusoidal code data representing segments of the approximation from said transmitted or restored code data;

a synthesiser synthesizer for re-constructing said segments from said received sinusoidal code data; and a joining unit for joining consecutive segments to form said approximation of the audio or speech signal;

wherein the sinusoidal code data is a plurality of frequency and amplitude values for at least one component of said segments; wherein the synthesizer is adapted to re-construct said segments from said sinusoidal code data according to an extension represented by the following formula:

$$\hat{x} = \sum_{i=1}^{L} Ci = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i | represents a component Ci of the extension x̂ (n); |
| j,k | represent parameters; |
| n | represents a discrete time parameter; |
| $f_j$ | represents the jth instance out of the set of J linearly independent functions; |
| $\theta_k^i$ | represents the phase coefficient value as one of said sinusoidal data |
| $\Theta^i$ | is a phase; and |
| $d_j^i, e_j^i$ | represent the linearly involved amplitude values of the components representing parts of said sinusoidal data. |

12. Decoding method for reconstructing an approximation of an audio or speech signal from transmitted or restored code data, comprising the acts of selecting sinusoidal code data representing segments of the approximation from said transmitted or restored code data;

re-constructing said segments from said sinusoidal code data; and joining consecutive ones of said segments together in order to form said of the audio or speech signal;

wherein the sinusoidal code data is a plurality of phase and amplitude values for at least one component of said segment, wherein in said re-construction act the segments are re-constructed from said sinusoidal code data according to an extension represented by the following formula:

$$\hat{x} = \sum_{i=1}^{L} Ci = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i | represents a component Ci of the extension x̂ (n); |
| j,k | represent parameters; |
| n | represents a discrete time parameter; |
| $f_j$ | represents the jth instance out of the set of J linearly independent functions; |
| $\theta_k^i$ | represents the phase coefficient as one of said sinusoidal data |
| $\Theta^i$ | is a phase; and |
| $d_j^i, e_j^i$ | represent the linearly involved amplitude values of the components representing parts of said sinusoidal data. |

13. Data stream comprising sinusoidal code data representing a segment of an approximation of an audio or speech signal, wherein the sinusoidal code data is a plurality of phase and amplitude values for at least one component of said segment, wherein the segment is defined according to an extension represented by to:

$$\hat{x} = \sum_{i=1}^{L} Ci = \sum_{i=1}^{L} \sum_{j=0}^{J-1} [d_j^i f_j(n)\cos(\Theta^i(n)) + e_j^i f_j(n)\sin(\Theta^i(n))]$$

with $$\Theta^i(n) = \sum_{k=1}^{K} \theta_k^i n^k$$

wherein:

| | |
|---|---|
| i | represents a component Ci ofthe extension x̂ (n); |
| j,k | represent parameters; |
| n | represents a discrete time parameter; |
| $f_j$ | represents the jth instance out of the set of J linearly independent functions; |
| $\theta_k^i$ | represents the phase coefficient as one of said sinusoidal data |
| $\Theta^i$ | is a phase; and |
| $d_j^i, e_j^i$ | represent the linearly involved amplitude values of the components representing parts of said sinusoidal data. |

14. Storage medium on which a data stream as claimed in claim 13 has been stored.

* * * * *